US005289651A

United States Patent [19]

Byers

[11] Patent Number: 5,289,651

[45] Date of Patent: Mar. 1, 1994

[54] PHOTO DISPLAY DEVICES

[76] Inventor: Thomas L. Byers, 5840 Stewart Dr., Mustang, Okla. 73064

[21] Appl. No.: 908,300

[22] Filed: Jul. 2, 1992

Related U.S. Application Data

[63] Continuation-in-part of Ser. No. 628,164, Dec. 17, 1990.

[51] Int. Cl.[5] ..... G09F 19/02

[52] U.S. Cl. ..... 40/533; 40/500; 40/537

[58] Field of Search ..... 40/373, 388, 389, 390, 40/533, 405, 475, 497, 500, 501, 530, 532, 534, 537, 377, 378, 379, 493, 494, 499, 531, 399, 506, 159, 661, 370, 470; 74/142

[56] References Cited

U.S. PATENT DOCUMENTS

| | | | |
|---|---|---|---|
| 380,090 | 3/1888 | Clot | 40/370 |
| 421,266 | 2/1890 | Glover | 40/500 |
| 512,034 | 1/1894 | Kiler | 40/370 |
| 686,965 | 11/1901 | Breton | 40/475 |
| 978,162 | 12/1910 | Hopkins . | |
| 1,006,188 | 10/1911 | Edson | 40/370 |
| 1,126,814 | 2/1915 | Manetsch et al. . | |
| 1,214,732 | 2/1917 | Hopkins et al. | 40/500 |
| 1,596,741 | 8/1926 | Kranz | 40/494 |
| 1,713,140 | 5/1929 | McDonald | 40/475 |
| 1,813,442 | 7/1931 | Dobrowsky . | |
| 1,848,296 | 3/1932 | Hueber . | |
| 2,554,941 | 5/1951 | Dobrowsky . | |
| 2,703,744 | 3/1955 | Karper . | |
| 2,761,750 | 9/1956 | Neilsen . | |
| 3,212,205 | 10/1965 | Alleman . | |
| 3,218,743 | 11/1965 | Shneider . | |
| 3,260,006 | 7/1966 | Dunajew . | |
| 3,261,649 | 7/1966 | Erickson et al. . | |
| 3,323,243 | 6/1967 | Blair | 40/499 |
| 3,964,428 | 6/1976 | Arai . | |
| 3,973,339 | 8/1976 | Ueda . | |
| 4,021,947 | 5/1977 | Shneider . | |
| 4,215,511 | 8/1980 | Todokoro | 40/475 |
| 4,514,919 | 5/1985 | Plutsky | 40/159 |
| 4,530,176 | 7/1985 | Rejwan . | |
| 4,599,815 | 7/1986 | Waldo | 40/377 |
| 4,832,369 | 5/1989 | Johnson et al. . | |

FOREIGN PATENT DOCUMENTS

| | | | |
|---|---|---|---|
| 619299 | 3/1949 | United Kingdom | 40/500 |

*Primary Examiner*—Kenneth J. Dorner
*Assistant Examiner*—J. Bonifanti
*Attorney, Agent, or Firm*—Dougherty, Hessin, Beavers & Gilbert

[57] ABSTRACT

An improved photo display device of the type having a housing with frame and double photograph envelope providing dual photo viewing as presented within the frame, a first improvement consisting of an alternative picture rotating mechanism that includes both a manual ratcheting system on one side of the housing and a motor drive or automatic ratcheting system on the other side, and a second improvement that consists of a unitary housing/frame formation that receives a spindle assembly directly through the front frame which is then secured by side entry and snap-fit of right and left ratcheting knob assemblies.

10 Claims, 4 Drawing Sheets

PHOTO DISPLAY DEVICES

CROSS-REFERENCE TO RELATED APPLICATIONS

The present invention is related to subject matter of prior U.S. patent application Ser. No. 07/591,052, now U.S. Pat. No. 5,163,240, as filed on Oct. 1, 1990 and entitled "Improved Photo Display Device" and a continuation-in-part application Ser. No. 07/628,164 as filed on Dec. 17, 1990.

BACKGROUND OF THE INVENTION

1. Field of the Invention

The present invention relates to improved construction techniques and rotary drive mechanisms for multiple photograph display boxes.

2. Description of the Prior Art

Prior types of card index device are of general interest only since they are most often characterized by the fact that only one side of the card need be displayed after indexing. An early U.S. Pat. No. 1,813,442 discloses a mechanized rotary-type sign display which includes the two fields of view, i.e., the front of the top card is displayed simultaneously with the backside of the bottom card. U.S. Pat. No. 1,126,814 discloses another form of picture display device wherein rotary cartridges each containing a number of pictures are selectively displayed.

U.S. Pat. No. 978,162 discloses yet another form of picture exhibiting apparatus wherein the multiple of pictures is rotated in a horizontal plane about a vertical axis. The U.S. Pat. No. 3,218,743 discloses a picture exhibiting apparatus that uses an album-type collection of individual photographs wherein each album can be inserted in the display device for subsequent individual viewing of the pictures. European patent application No. 82104601.8 is of particular interest in that it teaches a rotary menu card holder for use in a microwave oven wherein both backside and frontside of the cards are presented for view as the device is flipped over.

SUMMARY OF THE INVENTION

The present invention relates to improvements in construction of a photo display device, which improvements are largely directed to the rotary drive and/or movement control elements and the manner in which they are integrally contained within the housing structure to control presentation of the multiple picture spindle. In particular, a unitary rear housing assembly coacts with the front frame to secure the picture spindle assembly in operative position. The spindle assembly is adapted to receive a ratchet wheel on each respective side with a motor and drive linkage operable to rotate the spindle via one ratchet wheel while a mechanical ratcheting arm functions with the opposite side ratchet wheel to provide picture change upon manual operation. Thus, the device is very much simplified while still offering automatic operation versus manual selection operation of the picture sequencing.

The present improvements in design take into account the possibility of using a uni-body construction, i.e., the frame and housing integrally formed as might be cast or otherwise formed from such as ceramics, wood or other materials. In this structure, the opposite housing sides are formed with aligned holes so that a suitable spindle structure inserted between the holes can be operationally secured by insertion of opposite side knob structures through the holes for interlocking within the ends of the spindle assembly. A ratchet/bearing structure may be externally inserted to act in combination with the respective knob thereby to provide the necessary directional ratcheting function.

Therefore, it is an object of the present invention to provide a picture display device of simplified, yet more reliable construction.

It is also an object of the present invention to provide a multi-component picture display device that is highly fool-proof in assembly and operation.

It is yet further an object of the invention to provide a picture display device having mechanism that is more reliable in operation while also exhibiting increased longevity of trouble-free service.

Finally, it is an object of the present invention to provide a display device that is rugged of physical construction while also being reliable in operation.

Other objects and advantages of the invention will be evident from the following detailed description when read in conjunction with the accompanying drawings which illustrate the invention.

DETAILED DESCRIPTION OF THE INVENTION

Figure 1:
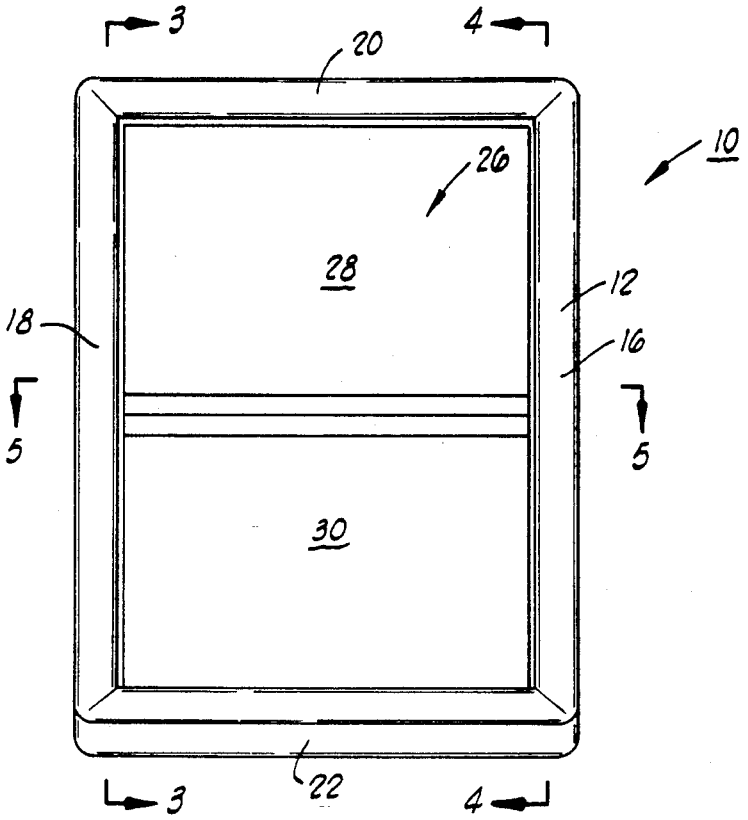
FIG. 1 is a front view in elevation of the display device.
Figure 2:
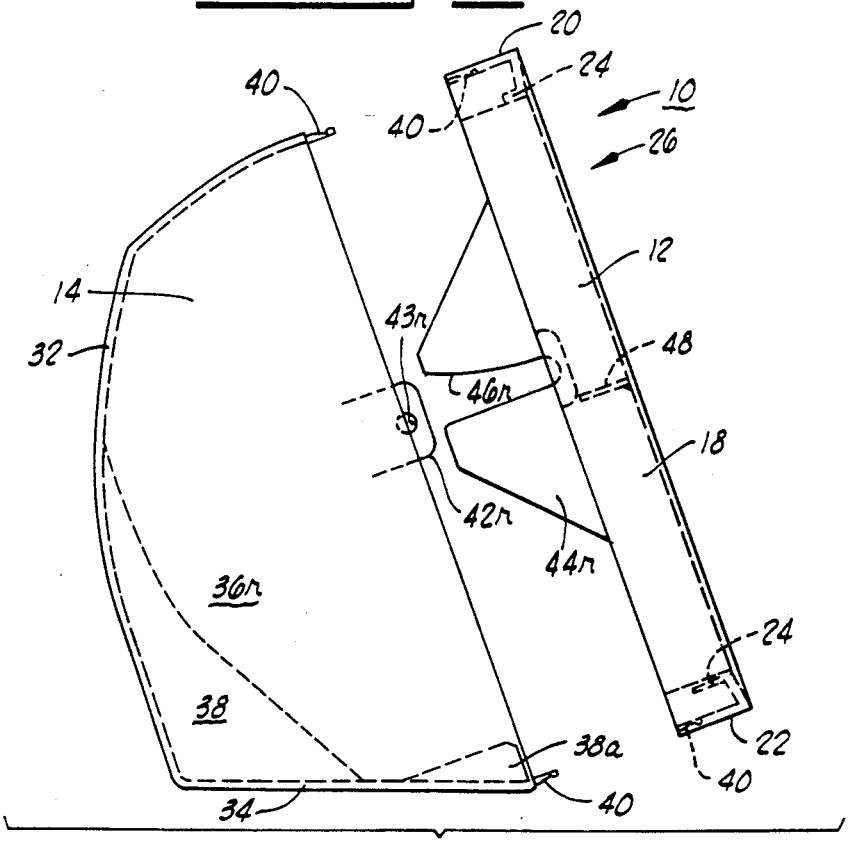
FIG. 2 is an exploded side view of the display device.

Referring to FIGS. 1 and 2, a photograph display device 10 includes a front frame 12 that is adapted for snap-fit into a housing 14. A comb 24 is formed around the inner edge of frame 12. The rectangular front frame 12 includes opposite sides 16 and 18, top 20 and bottom 22 and provides a double picture field of view. That is, the front viewing area 26 is divided into an upper area 28 for viewing a first picture and a lower viewing area 30 for displaying a second picture. Viewing areas 28 and 30 are each adapted to present standard-size photographs for viewing, e.g., $3\frac{1}{2} \times 5$ inch ($9 \times 12.7$ cm) snapshot prints, as will be further discussed below. An upper comb extension 24*a* provides an upper escapement from which successive picture envelopes release.

The housing 14 is unitarily formed in the manner shown generally in FIG. 2. It consists of a generally rounded back and top portion 32 continuing into a base or foot portion 34 while having left and right side panels 36*l* and 36*r*. An intermediate stiffening rib 38 is formed in the inside rear of the housing 14, the forward edge of which serves as a guide for movement of the photoroll. A forward extension of the rib 38, i.e., 38*a*, extends centrally forward and serves as the lower escapement as will be further described below. A plurality of housing latch members 40 are formed around the opening of housing 14 for engagement within the periphery of frame 12 upon assembly.

A housing journal extension tab 42*l* and *r* is formed to extend from each inner, side of sidewalls 36*l* and 36*r*, and each of the tabs 42*l* and 4*r* includes a respective journal hole 43*l* and *r* for receiving the picture spindle hub axle. The front frame 12 has formed on each side an inside wall extension 44*l* and *r* having longitudinal spindle slot 46*l* and *r* for the purpose of retaining the photo/spindle assembly on each side and maintaining proper alignment during, operation. Finally, FIG. 2 also shows at front frame 12 that the respective ratchet pawl 48*l* and *r* is molded integrally therewith, as will be further described below.

Figure 3:
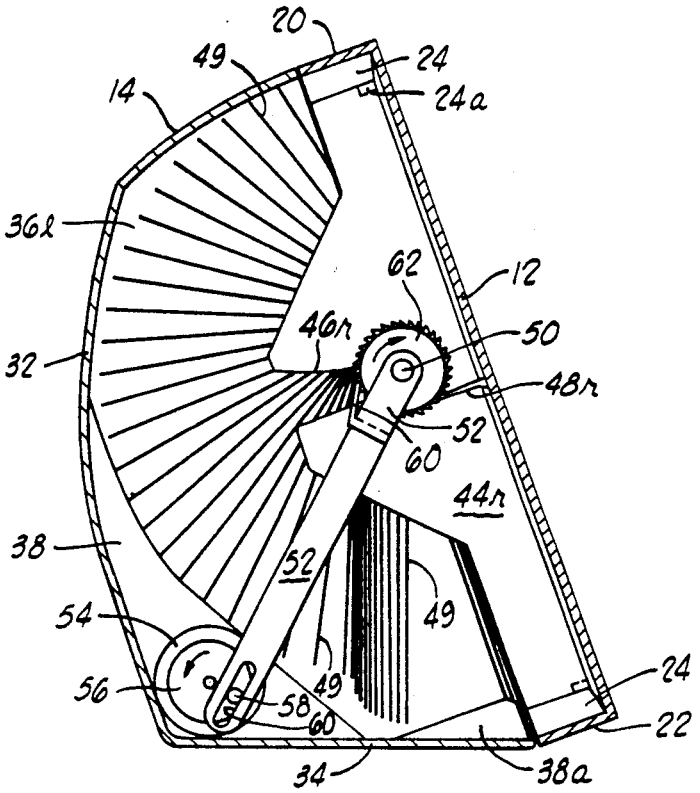
FIG. 3 is a vertical section taken along lines 3—3 of FIG. 1.

Referring now to FIG. 3, there is shown the automatic or motor-driven implements of the present invention. The assembly as shown is in operation with the spindle and envelope assembly in place. Thus, the spindle axle 50 is retained in ratchet arm 52 and the individual envelopes 49 are shown in circular array. An electric motor 54 is mounted in the lower rear corner of housing 14 and motor 54 provides very slow rotational output to a crank wheel 56 which has a crank pin 58 engaged within a slot 60 of crank arm 52. Motor 54 may be any of various commercially available electric motors that include necessary gear structure for providing low rpm output. Thus, it is apparent that with counterclockwise movement of crank wheel 56, the ratchet arm 52 is driven upward as pawl member 60 drives ratchet wheel 62 forward for one notch such that a next-to-release envelope is pushed past the escapement block at the top comb 24 and allowed to fall to the bottom.

Figure 4:
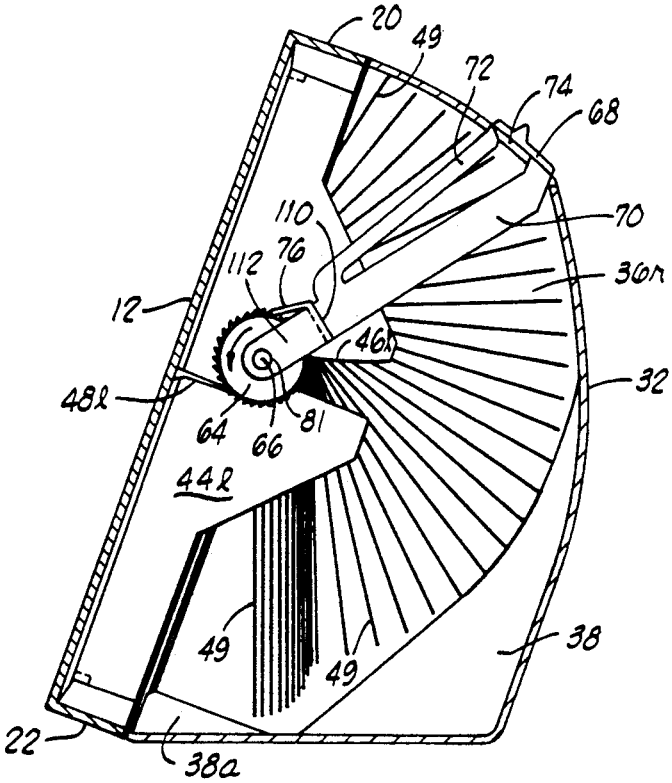
FIG. 4 is a side view in section taken along lines 4—4 of FIG. 1.

FIG. 4 shows the opposite side of the photo display 10, the manual operational component. This side of the spindle has a ratchet wheel 64 affixed thereon between the array of envelopes 49 and the outer axle 66. A ratchet arm actuator consists of a thumb slide 68 that is unitarily formed to extend into a ratchet arm 70 that is formed to include a return spring 72 integral therewith. Thus, both the ratchet arm 70 and the return spring 72 are inserted through the actuation slot 74 at the rear top of housing 32. A ratchet pawl 76 is affixed for movement with ratchet arm 70 as it is in engagement with the teeth of the manual ratchet wheel 64. The inner end of ratchet arm 70 includes a hole 81 for receiving the axle 66 of the spindle assembly. Thus, it is apparent that forward movement of the ratchet arm slide actuator 68 will result in engagement of pawl 76 with ratchet wheel 64 to give it a forward urging sufficient to rotate the envelope assembly through release of a single envelope 49.

Figure 5:
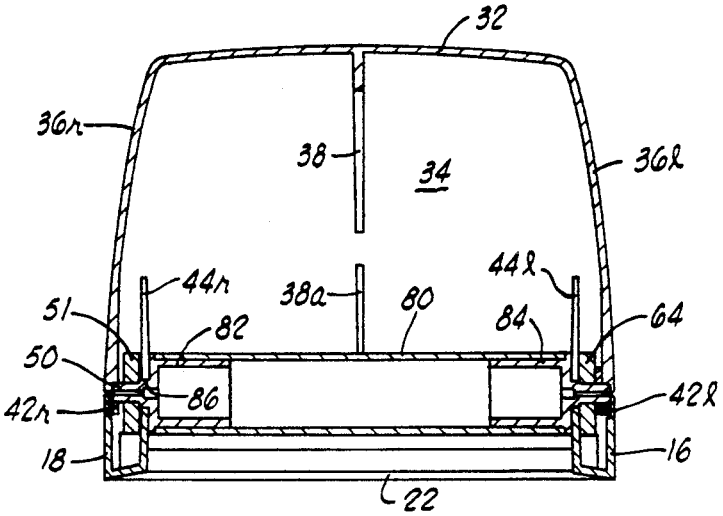
FIG. 5 a top plan view of a horizontal section taken through the spindle assembly.
Figure 6:
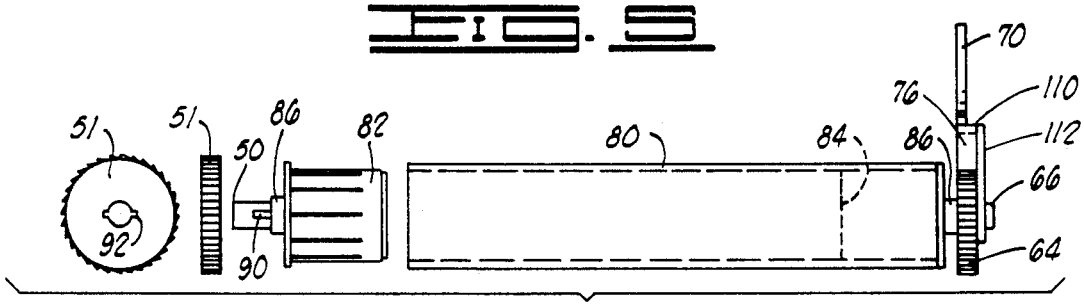
FIG. 6 is an exploded view of the spindle tube with ratchet and hub structure.

Referring to FIG. 5, a generally horizontal section through the display device 10 illustrates the seating of the spindle assembly to good advantage. Referring also to FIG. 6, a tubular spindle 80 receives a respective spindle hub 82, 84 in insertion in each end. Each of spindle hubs 82, 84 is constructed, as shown in FIG. 6, to include an axle journal 86 and an axle 50, 66 having a locking tab 90. On the left hand side of the spindle assembly, the ratchet wheel 51 fits over axle 50 as locking tabs 90 engage within locking grooves 92 on the ratchet wheel. Opposite ratchet wheel 64 is similarly locked onto axle 86 on the opposite side of the display device. The very outer ends of axles 50, 66 are then snap-fit into the holes 43*l* and *r* within opposite housing journal extension tabs 42*l* and *r* (see FIG. 2).

Figure 7A:
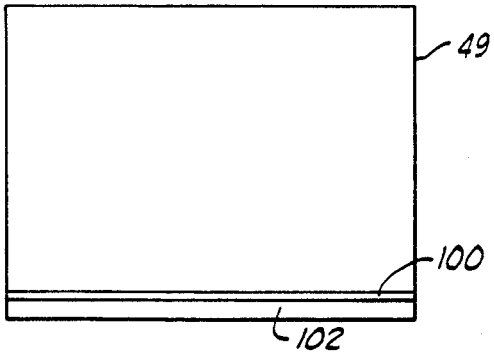
FIG. 7A is a plan view of a photograph envelope constructed in accordance with the invention.
Figure 7B:
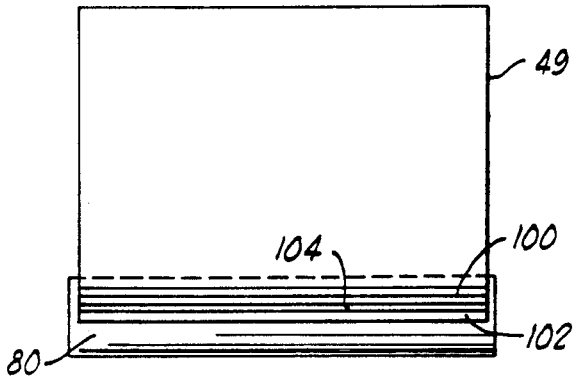
FIG. 7B is a plan view illustrating the manner of attaching an envelope to the spindle.
Figure 7C:
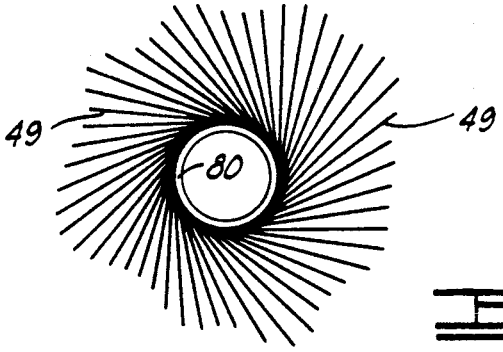
FIG. 7C is a side view in elevation of a spindle assembly including attachment of all photograph envelopes.

The plurality of envelopes 49 are assembled and secured onto the spindle 80 in the same manner as in the related patent applications. That is, each envelope 49 of selected picture size is formed of a single sheet folded over to form one longer end and one shorter end having open left and right sides, the shorter end being sealed to the long end by a heat weld 100 drawn across one edge and spaced to leave a tab portion 102. While any of numerous types of plastic films may be utilized to construct the spindle and envelope assembly, very good results have been achieved using polypropylene. Referring to FIG. 7B, the individual envelopes 49 are secured to the spindle 80 by successively heat welding the tab portions 102 of a plurality of envelopes 49 therearound. In FIG. 7B, the heat weld 104 would function to secure a single envelope 49 and a plurality of such heat welds would be distributed therearound to retain as many envelopes as desired. By using the same type of polymer for formation of the envelopes and spindle, there is brought about an easy, secure weld that enables a large number of envelopes to be secured around each spindle in close spacing with each envelope 49 freely moveable in hinge-like attachment. With about a 25 millimeter (one inch) diameter spindle 80, as many as fifty envelopes can be secured in the array without undue crowding, thus accommodating one hundred photographs with two per envelope 49.

Referring again to FIG. 6, there is shown a novel formation of crank arm 70. See also FIG. 4. The crank arm 70 is formed with an outwardly bent shoulder 110 which extends tab 112 on downward to provide journal support for spindle axle 66. Thus, the shoulder 110 provides outboard clearance around the ratchet wheel 64. At the same time, a flange bent angularly downward provides formation of the pawl 76. In FIG. 3, the ratchet arm 52 is similarly formed with a shoulder bend providing clearance of ratchet wheel 62 as well as support of spindle axle 50 while a flange bend 60 serves as ratcheting pawl. (See FIG. 3.)

In operation, the spindle 80 can be loaded so that each of envelopes 49 includes its two opposed photos, and respective spindle hubs 82 and 84 (FIG. 6) are placed in spindle 80, each carrying respective ratchet wheel 62 and 64. Referring to FIG. 2, the spindle/picture envelope assembly is then force fit into the journal extension tabs 42*l* and *r* extending from the side walls 36*l* and *r* of housing 14. Thereafter, the front frame 12 is force-fit onto the front part of housing 14 with each of the opposite inside wall extensions 44*l* and *r* sliding closely adjacent the spindle hubs 82 and 84 (see FIG. 5) with opposite-side spindle slots 46*l* and *r* sliding around the opposite side axle journals 86 (see FIG. 6). The front frame 12 then snaps into place over the front of housing 14 and is clamped there by virtue of latch members 40.

Referring now to FIGS. 3 and 4, when the front frame 12 is engaged on the front of housing 14, with the spindle/envelope assemblies positioned therein, the crank arm 52 (FIG. 3) will have been placed over the spindle axle 50 with pawl 60 engaging ratchet wheel 62. In like manner, the manual control on the other side of the display device will also be in proper assembly as manual ratchet arm 70 is positioned over spindle axle 66 with pawl 76 engaging the ratchet wheel 64. The display device is then fully operational and ready for either automatic or manual operation.

For automatic operation, an electric switch and power source (not shown) may be energized to energize motor 54 which rotates at very slow revolutions per minute thereby to oscillate ratchet arm 52 through a series of ratchet wheel movements, each of which frees the next envelope 49 from the upper escapement 24*a* so that it falls down against the lower escapement 38*a* for the duration of a viewing pause. A picture can be viewed both in the top viewing space 28 and the bottom viewing space 30 in each instance.

Manual actuation takes place in similar manner as the thumb slide 68 and ratchet arm 70 move forward against the compression of spring 72. There is a movement of ratchet wheel 64 sufficient to free an envelope 49 from the upper escapement 24*a* so that it falls down below against the lower escapement 38*a* to expose a next succession of upper and lower pictures. The spring tension of return spring arm 72 moves the slide switch 68 to its rest position and no further movement of pictures or rotation of envelopes 49 takes place until a next manual movement forward of the thumb slide 68.

Figure 8:
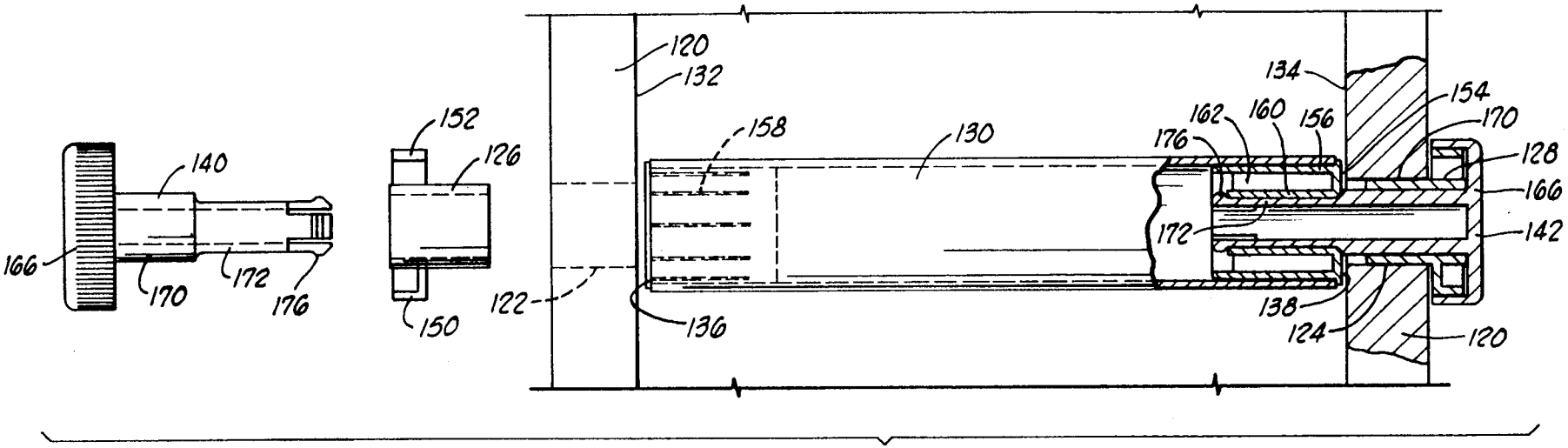
FIG. 8 an exploded view of spindle assembly and knob structure as installed in the housing structure, the right side knob structure being shown in section.

In FIG. 8, an alternative form of spindle assembly is utilized with a unitary housing/frame assembly 120. Only the opposite side portions of the housing/frame 120 are shown for the sake of expediency; however, the overall shape of housing/frame 120 would take the same essential shape as other two-piece counterparts and the interior space, i.e., the revolving space wherein the spindle and envelopes rotate would be of the similar arcuate enclosure. The opposite sides of housing/frame 120 are fitted with equal sized holes 122, 124 near the front of housing/frame 120 and holes 122, 124 receive respective ratchet bearing members 126, 128 therein keyed, as will be further described.

A spindle 130 for carrying the circumfery of attached dual picture envelopes, as previously described, is formed of a length that just barely fits within the opposite inner side walls or envelope guides 132 and 134 and each end of spindle 130 receives a respective spindle insert 136 and 138 in tightly interlocked affixure. The spindle insert 136 is shown in dash-line and will be further described in relation to FIG. 10. Finally, the entire assembly is completed when the opposite side knobs 140 and 142 are inserted and snapped into interlocking position, also to be further described below.

Figure 9B:
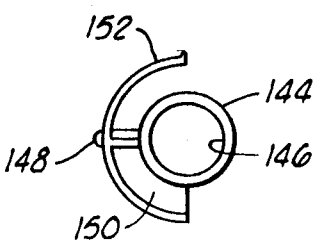
FIG. 9B is a top plan view of the ratchet key of FIG. 9A.
Figure 9A:
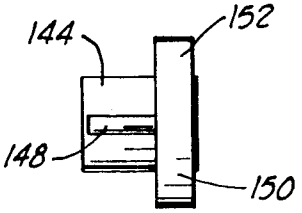
FIG. 9A is a side view of a ratchet key constructed in accordance with the invention.

Referring now to FIGS. 9A and 9B, the ratchet/bearings 126 and 128 are of identical construction except that they are formed as a mirror image counterpart, each having a tubular body 144 which is sized to fit within the respective holes 122 and 124, and the tubular body 144 provides a bushing surface 146 therethrough. A directional key tab 148 is formed on tubular body 144 for interlocking insertion within a keyway (not specifically shown) that is formed in the holes 122 and 124 and the side walls of housing/frame 120. A radially extending comb 150 is then formed around the outer end of tubular body 144 extending a concentric ratchet pawl 152 therearound for coaction with the ratcheting knob as will be further described.

Figure 10:
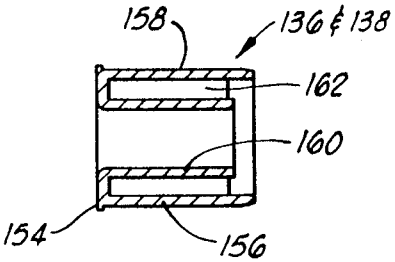
FIG. 10 is a view in section of a spindle insert as shown in FIG. 8.

FIG. 10 shows a sectional view of the spindle inserts 136 and 138. The spindle inserts 136 and 138 are each formed with an outer flange 154 with a barrel 156 having a plurality of interfering vanes 158 (see FIG. 8) formed around the circumfery to assure a tight and relatively permanent grip inside of the spindle tube 130. An inner square passage 160 as supported by sufficient webbing 162 (particularly shown) is formed concentrically within barrel 156 for coaction with a mating square portion of the control knob, as will be further described below.

Figure 11:
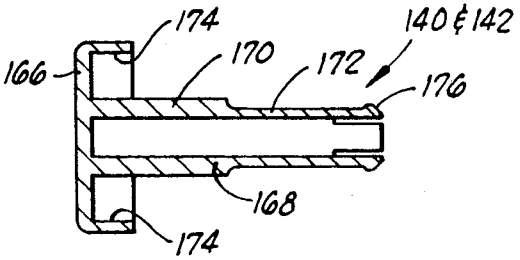
FIG. 11 is a view in vertical section of a knob as shown in FIG. 8.

Referring now to FIG. 11, the knobs 140 and 142 each consist of an outer knob 166 formed on a tubular shaft 168 which consists of an outer round portion 170 for smooth engagement within bushing 146 (see FIG. 9B) and a square portion 172 for locking engagement within the square inner tube 160 of the spindle hubs 136 and 138 (see FIG. 10). A plurality of ratchet teeth 174 are formed around the inner edge of knob 166 for coaction with ratchet pawl 152 (FIG. 9B) when assembly is complete. A quadrature array of pliable snaps 176 are formed on the inner end of tubular member 168 for locking the knob assembly 140, 142 in place when fully assembled.

The assembled structure is shown to good advantage in the sectional view of FIG. 8.

In the assembly of the unitary embodiment, and referring primarily to FIG. 8, the spindle 130 with plurality of dual picture envelopes is manually inserted into the open front frame of housing/frame 120 with the opposed spindle inserts 136 and 138 aligned with respective holes 122 and 124. The ratchet inserts 126 and 128 will already have been inserted from outside in into the support holes 122 and 124. Thereafter, the respective knobs 140 and 142 will be inserted through respective bushings 146 of ratchet/bearing members 126 and 128 until the circular races 170 ride within bushings 146 (each side) and the square tubing sections 172 are inserted through the inner square tube 160 of each spindle insert 136 and 138 so that their respective locking tabs expand outward in interlocking manner. When so assembled, ratchet teeth 174 within the cowl of knob 166 will engage over ratchet pawls 152 to restrict the spindle rotation to one direction while controlling release in the opposite direction of successive upwardly disposed dual picture envelopes so that each falls downward to the lower escapement position for viewing of the opposite side photo.

The foregoing discloses a novel form of picture display wherein both automatic and manual actuation may be utilized, both types of actuation being effected with a relatively basic type of mechanism. The device is capable of very reliable operation, either automatic or manual, and it is easily adaptable for use with a plurality of spindle/envelope picture combinations in what may be termed an album-type of operation.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A device for storage and display of photographs comprising:

a housing having a generally rectangular open front with top, bottom and opposite sides;

a frame defining upper and lower photograph viewing areas, said frame being releasably positioned over said open front of the housing;

a spindle assembly including plural envelopes resiliently secured successively therearound, each envelope containing photos viewable through each side, said spindle assembly being rotatably positioned in bisection of said housing open front;

a ratchet wheel secured on one end of said spindle assembly and rotatable therewith;

a ratchet arm having first and second ends with said first end rotatively secured to one end of said spindle assembly and extending a ratchet pawl into engagement with said ratchet wheel; and a motor and crank wheel slidingly engaged with the ratchet arm second end to cause angular reciprocation and movement of the ratchet pawl to cause intermittent rotations of the ratchet wheel thereby to move each successive envelope from the upper viewing area to the lower viewing area.

2. A device as set forth in claim 1 wherein said spindle assembly further comprises:

a spindle tube having said plural envelopes secured sequentially therearound; and first and second spindle hubs inserted into opposite ends of said spindle tube and each hub extending a spindle axle, for engagement in opposite sides of said housing open front.

3. A device as set forth in claim 2 wherein:

said ratchet wheel is received onto one of said spindle axles and positioned adjacent the spindle tube.

4. A device as set forth in claim 3 which is further characterized to include:

a pawl formed integrally with said frame at a side position adjacent the spindle assembly for engaging said ratchet wheel and preventing back-up of said ratchet wheel.

5. A device as set forth in claim 1 wherein said frame further comprises:

top, bottom and opposite side members joined into a rectangular frame;

first and second frame inside wall extensions each disposed on a respective side member and each positioned to extend inside of said housing in close alignment to a respective edge of said plural envelopes to retain photographs therein.

6. A device for storage and display of photographs, comprising:

a housing having a generally rectangular open front with top, bottom and opposite sides;

a frame defining upper and lower photograph viewing areas, said frame having top, bottom and opposite side members and being releasably positioned over said open front of the housing, said frame also having first and second inside wall extensions each disposed on a respective opposite side member and each positioned to extend in parallel inside of said housing;

a spindle assembly including plural envelopes resiliently secured successively therearound, each envelope containing photos viewable through each side, said spindle assembly being rotatably positioned in bisection of said housing open front with envelopes closely aligned between said first and second inside wall extensions;

a ratchet wheel secured on one end of said spindle assembly and rotatable therewith; and a ratchet arm having first and second ends with said first end rotatively secured to one end of said spindle assembly and extending a ratchet pawl into engagement with said ratchet wheel, and with the second end adapted to extend through an opening in said housing for sliding movement of the second end outside said housing to provide manual operation to ratchet said ratchet wheel and spindle assembly.

7. A device as set forth in claim 6 wherein said spindle assembly further comprises:

a spindle tube having said plural envelopes secured sequentially therearound; and first and second spindle hubs inserted into opposite ends of said spindle tube and each hub extending a spindle axle, for engagement in opposite front sides of said housing.

8. A device as set forth in claim 7 wherein:

said ratchet wheel is received onto one of said spindle axles and positioned adjacent the spindle tube.

9. A device as set forth in claim 8 which is further characterized to include:

a pawl formed integrally with said frame at a side position adjacent the spindle assembly for engaging said ratchet wheel and preventing back-up of said ratchet wheel.

10. A device as set forth in claim 6 which is further characterized to include:

a second ratchet wheel secured on the opposite end of said spindle assembly and rotatable therewith;

a second ratchet arm having first and second ends with said first end rotatively secured to the opposite end of said spindle assembly and extending a second ratchet pawl into engagement with said second ratchet wheel; and a motor and crank wheel slidingly engaged with the second ratchet arm second end selectively to cause angular reciprocation and movement of the second ratchet pawl to effect intermittent rotation of the second ratchet wheel thereby to move each successive envelope from the upper viewing area.

* * * * *